US005119902A

United States Patent [19]

Geddes

[11] Patent Number: 5,119,902

[45] Date of Patent: Jun. 9, 1992

[54] ACTIVE MUFFLER TRANSDUCER ARRANGEMENT

[75] Inventor: Earl R. Geddes, Livonia, Mich.

[73] Assignee: Ford Motor Company, Dearborn, Mich.

[21] Appl. No.: 514,624

[22] Filed: Apr. 25, 1990

[51] Int. Cl.[5] ..... F01N 1/06

[52] U.S. Cl. ..... 181/206; 181/156; 381/71

[58] Field of Search ..... 181/206, 207, 227, 156; 381/71

[56] References Cited

U.S. PATENT DOCUMENTS

| | | | |
|---|---|---|---|
| 1,969,704 | 8/1934 | D'Alton | 181/156 |
| 4,153,815 | 5/1979 | Chaplan et al. | 381/71 |
| 4,473,906 | 9/1984 | Warnaka et al. | 181/206 X |
| 4,480,333 | 10/1984 | Ross | 381/71 |
| 4,549,631 | 10/1985 | Bose | 181/156 X |
| 4,665,549 | 5/1987 | Eriksson et al. | 381/71 |
| 4,669,122 | 5/1987 | Swinbanks | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |
| 4,783,817 | 11/1988 | Hamada et al. | 381/71 |
| 4,805,733 | 2/1989 | Kato et al. | 181/206 |
| 4,815,139 | 3/1989 | Eriksson et al. | 381/71 |
| 4,837,834 | 6/1989 | Allie | 381/71 |
| 4,876,722 | 10/1989 | Dekker et al. | 381/71 |
| 4,878,188 | 10/1989 | Ziegler, Jr. | 364/724 |

FOREIGN PATENT DOCUMENTS

| | | |
|---|---|---|
| 768373 | 8/1934 | France . |
| 2191063A | 12/1987 | United Kingdom . |

OTHER PUBLICATIONS

AES Bandpass Loudspeaker Enclosures Publication, Nov., 1986, 2383 (D-3).

*Primary Examiner*—Brian W. Brown

*Attorney, Agent, or Firm*—Mark L. Mollon; Roger L. May

[57] ABSTRACT

An active muffler for use in motor vehicles comprises a sensor, an electronic control responsive to the signal generated by the sensor for producing a drive signal delivered to a transducer which emits cancellation pulses phased 180° from the sound pressure pulses passing through a conduit, where both front and rear sides of the transducer are acoustically coupled to the conduit to improve the efficiency of the transducer operation. Preferably, the acoustic coupling comprises an enclosed chamber including a port for communicating with the conduit which can be tuned to resonate at predetermined frequencies. When both sides of the transducer are so coupled to the conduit, the transducer has increased efficiency over a broad band of frequencies, and the frequency band can be broadened at the low end as required to accommodate the frequencies generated by a source of noise. The transducer mounting arrangement according to the present invention is particularly suitable for use in adapting noise cancellation techniques to replace passive mufflers on motor vehicles.

8 Claims, 1 Drawing Sheet

FIG 1
PRIOR ART
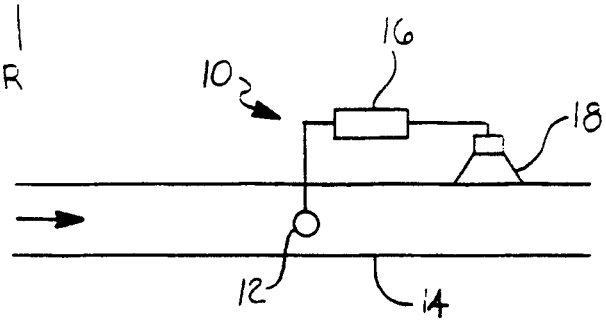
FIG 2
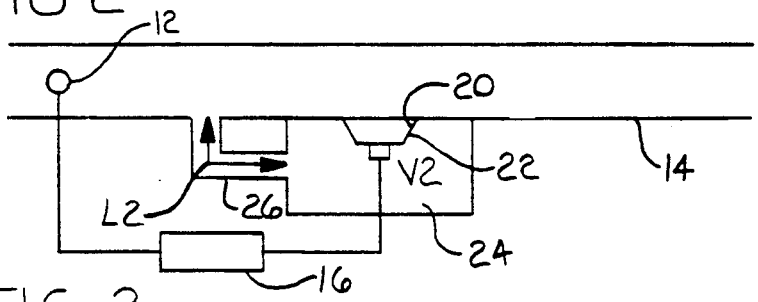
FIG 3
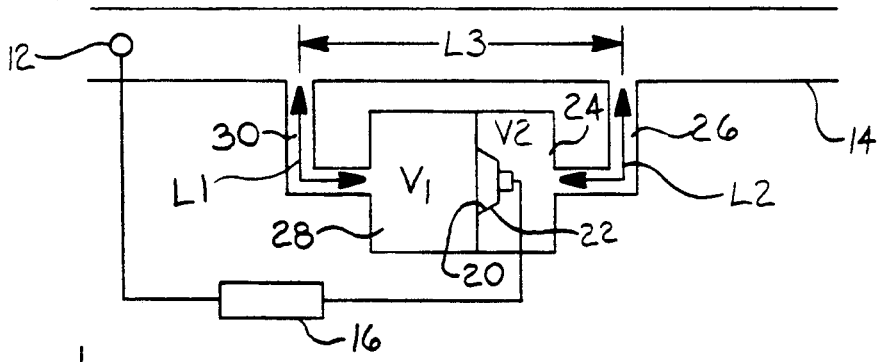
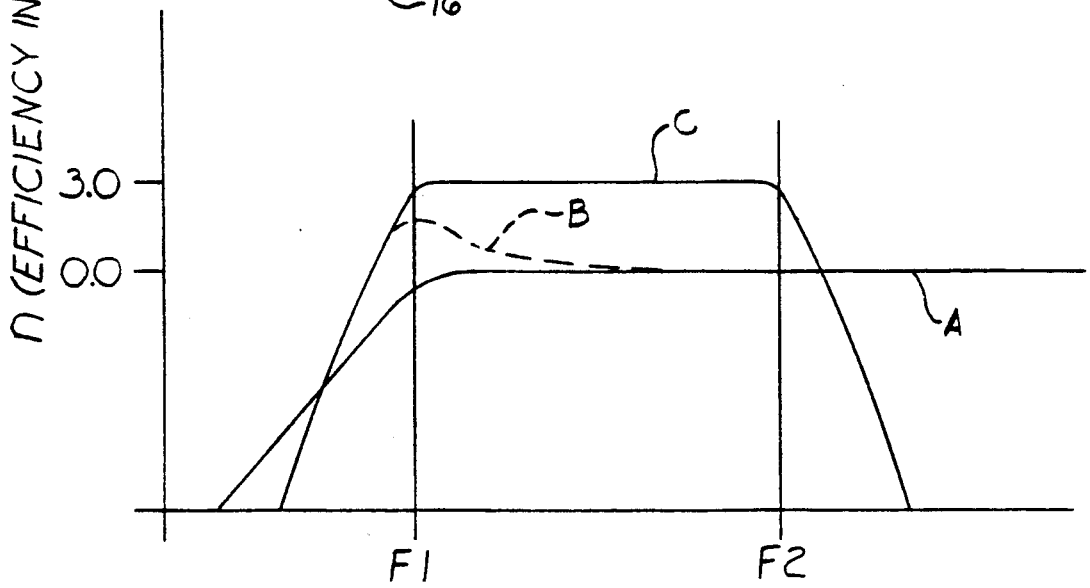
FIG 4

ACTIVE MUFFLER TRANSDUCER ARRANGEMENT

TECHNICAL FIELD

The present invention relates generally to noise reduction apparatus, and more particularly to active sound cancellation devices made applicable for use with motor vehicles.

BACKGROUND ART

Internal combustion engines typically used in motor vehicles generate a substantial amount of noise due to the combustion occurring within the engine. Conventionally, the noise generated is suppressed by a passive muffler system in which the sound waves are broken up by resonance with baffles, passageways and the like or absorbed by fibrous material. However, such techniques of reducing the sound level also obstruct the free flow of exhaust gases through the exhaust conduits and therefore substantially interfere with efficient operation of the vehicle's engine by interfering with the release of combustion products and inhibiting the replacement of the combusted gases with fresh fuel in the engine cylinders. Nevertheless, despite the reduction in economy and performance, the need for substantially reduced noise levels requires the use of such mufflers on all production motor vehicles.

Although active noise cancellation systems have been employed with large ducts used for heating and ventilation in large buildings, the previously known systems are not well adapted for use in the environment of motor vehicles. For example, U.S. Pat. No. 4,473,906 to Wanaka et al discloses numerous prior art sound attenuation system embodiments. In general, sensed sound pressure produces a signal adapted to drive a loudspeaker for inputting cancellation signals into the duct. The cancellation signal is an acoustic pulse signal 180° out of phase with the signal passing past the speaker through the duct. The prior art embodiments also illustrate improved noise attenuation performance by reducing the effect of the feedback of the cancellation signal which arrives at the sensor. The patent discusses the inclusion of additional transducers and electronic controls to improve the performance of the active acoustic attenuator.

U.S. Pat. No. 4,677,677 to Erickson further improves attenuation by including an adaptive filter with on-line modeling of the error path and the canceling speaker by using a recursive algorithm without dedicated off-line pretraining. U.S. Pat. No. 4,677,676 adds a low amplitude, uncorrelated random noise source to a system to improve performance. Likewise, U.S. Pat. Nos. 4,876,722 to Decker et al and 4,783,817 to Hamada et al disclose particular component locations which are performance related and do not adapt active attenuator noise control systems to motor vehicles. However, none of these improvements render the system applicable to muffle engine noise in the environment of a motor vehicle.

The patented, previously known systems often employ extremely large transducers such as 12 or 15 inch loudspeakers of conventional construction. Such components are not well adapted for packaging within the confines of the motor vehicle, and particularly, within the undercarriage of the motor vehicle. Moreover, since the lowest frequency of the signal which must be canceled is on the order of 25 hertz, it may be appreciated that a large loudspeaker is used under conventional wisdom to generate sound signals with sufficient amplitude in that range, and such speakers are not practical to mount beneath a motor vehicle. Moreover, although the highest frequencies encountered are easier to dissipate because of their smaller wavelength, the highest frequency to be canceled is on the order of 250 hertz.

Moreover, many of the prior art references teach the inclusion of such speakers within the ducts subjected to the sound pressure signal. It may be appreciated that the loudspeakers discussed above could not be installed in that manner in conventional exhaust conduits for motor vehicles. Furthermore, the harsh environmental conditions within such a chamber do not teach or suggest that such components can be employed in a motor vehicle. Moreover, while packaging considerations might suggest that the size of a speaker be reduced and compensated for by additional speakers of smaller size, such multiplication of parts substantially increases costs while reducing reliability.

Although there have been known techniques for increasing the efficiency of audio loudspeakers, those teachings have not been considered readily applicable to active noise attenuating systems. French Patent No. 768,373 to D'alton, U.S. Pat. No. 4,549,631 to Bose and the Bandpass Loudspeaker Enclosures publication of Geddes and Fawcett presented at the 1986 convention of the Audio Engineering Society acknowledge the phenomena of tuning loudspeaker output by the use of chambers including ports. The recognition of this phenomena has been limited to its effect upon audio reproduction, and particularly dispersion of the audio signal to an open area outside the loudspeaker enclosure. There is no teaching or suggestion in the prior art that noise cancellation techniques are improved by such phenomena. In addition, the closed conduit system of motor vehicle exhaust systems, and the harsh environment associated with such systems, do not suggest that loudspeaker developments for use in open areas are readily applicable or practical to provide active muffler systems in motor vehicles.

SUMMARY OF THE INVENTION

The present invention substantially reduces the difficulty of employing available active attenuation technology to motor vehicle exhaust systems by using the front and rear emissions from the transducer to effect cancellation of sound pressure pulses in a conduit enclosure. In general, at least one side of the speaker is enclosed within a chamber including a port acoustically coupled to the conduit for canceling sound pressure pulses in the conduit. Preferably, both sides of a transducer diaphragm are enclosed within separate chambers, each of which has a port. Each of the ported chambers is tuned for high and low ends, respectively, of a frequency band containing the sound pressure pulses to be canceled.

Thus, the present invention provides an active noise cancellation system particularly well adapted for use in motor vehicles since the increased efficiency of the transducer arrangement reduces the packaging requirements for the noise cancellation system. Moreover, the arrangement permits easier and protected mounting of the transducer despite the environment and high temperature conditions to which the system components are subjected.

Furthermore, the band width is particularly well adapted for use in the noise frequency range associated with conventional motor vehicle engines. Accordingly, the present invention renders active muffler systems applicable to motor vehicles in a practical way.

BRIEF DESCRIPTION OF THE DRAWINGS

The present invention will be more clearly understood by reference to the following detailed description when read in conjunction with the accompanying drawing in which like reference characters refer to like parts throughout the views and in which:

FIG. 1 is a diagrammatic view of a conventional noise attenuation system used for the ventilation ducts of buildings and the like;

FIG. 2 is a diagrammatic view similar to FIG. 1 but showing an improved transducer mounting arrangement according to the present invention for employing an active muffler in a motor vehicle;

FIG. 3 is a further diagrammatic view of an active attenuation system according to the present invention but showing a further modification of the transducer mounting, and FIG. 4 is a graphical representation of the performance of the embodiments shown in FIGS. 1-3 for the sake of comparison.

DETAILED DESCRIPTION OF THE BEST MODE

Referring first to FIG. 1, a known active noise cancellation system is diagrammatically illustrated to include a microphone 12 exposed to a sound pressure pulse train delivered from a source through a conduit 14. The electrical signal generated by the transducer 12 in response to the sound pressure pulses is fed into electronic control 16 which in turn drives a transducer !8 such as a loudspeaker. As is well known, the control 16 drives the transducer 18 so that the sound pressure is generated by the front of the speaker and introduced to the conduit 14. The emission occurs at a point at which the pulses emitted from the transducer 18 are 180° out of phase with the sound pressure pulses passing through the conduit 14 at that point.

Although there have been many improvements to the system shown in FIG. 1, the improvements do not relate to the transducers efficiently or space saving advantages for the conduit through which the sound pressure pulses travel. The previously known improvements to the control 16 so that it reacts to changing characteristics of the sound pressure pulses due to changes at the source, improved positioning or alignment of components to avoid feedback of the signal generated from the transducer 18 which is received at the transducer 12, and error compensation devices which readjust the control 16 in response to the actual degree of cancellation resulting from operation of the transducer 18 exhibit a substantially different emphasis upon development of the systems. Rather, all the known prior art employ a single face of the transducer diaphragm to produce cancellation pulses.

As shown in FIG. 2, the present invention makes use of the fact that the loudspeaker diaphragm has a front face, diagrammatically indicated at 20, and a rear face, diagrammatically indicated at 22. As a result, each movement of the diaphragm induces a pulse in the front side 20 which is 180° out of phase with the pulse generated at the rear side 22.

While the front face 20 is aimed toward the conduit 14, the rear face 22 is enclosed within a chamber 24 and communicating with a port 26 also aimed toward the conduit 14. As shown in FIG. 4, communication of the pulses transmitted from the back face 22 of the transducer 18 to the chamber 24 and the conduit 26 improves the low end response by expanding the low end of the frequency band. In addition, as shown by Line B in FIG. 4, the efficiency of the transducer at the low end improves significantly. The resonant frequency F, at which improved efficiency occurs, is proportional to $(L2 \cdot V2)^{-\frac{1}{2}}$.

More dramatic results are recognized when both the front and rear sides of the transducer are coupled through ported chambers as shown in FIG. 3. Chamber 24 enclosing the back side 22 of the transducer 18 has a volume V2 and a port 26 with a length L2. Front side 20 of the transducer 18 is enclosed within the chamber 28 having a volume V1 with a port of length L1. The outlets of the ports 30 and 26 communicate at spaced apart positions along the conduit 14 separated by a distance L3.

As demonstrated in FIG. 4 by plotted line C, such an arrangement provides substantially double the efficiency of a standard transducer noise cancellation setup as represented at plotted line A. Moreover, the frequency band throughout which the increased efficiency occurs is extended at the lower end and cut-off at an upper end F2. The high cut-off frequency F2 is proportional to the $(V1 \cdot L1)^{-\frac{1}{2}}$. For the purposes of motor vehicle engine exhaust, a conventional internal combustion engine exhaust valve would generate a maximum frequency of about 250 hertz.

Similarly, the lowest frequency Fl would be proportional to the $(V2 \cdot L2)^{-\frac{1}{2}}$. Typically, it will be determined as a convenient idle speed for the motor vehicle engine. As a result, volumes V1 and V2 of the chambers 28 and 24, respectively, as well as the lengths L1 and L2 of the ports 30 and 26, respectively, will be determined as necessary to provide increased efficiency throughout the frequency band in which the sound pressure pulses are passed through the exhaust conduit 14.

The best performance of such a system will occur where the length L3 is substantially less than the wavelength of the highest frequency F2 to be encountered during motor vehicle operation. In addition, L2 should be substantially less than the half wavelength of the highest frequency F2.

As a result of the tuning provided by the ported chambers of the transducer mounting arrangement of the present invention, the efficiency of the transducer is substantially increased. As a result, the size of the transducer and the energy required to operate the transducer can be substantially reduced over required transducers in previously known noise cancellation systems. In particular, the reduction of energy input requirements substantially reduces the need for power amplification components which are typically the most expensive portions of the electronic control 16. Moreover, the limited space available for packaging such components in a motor vehicle does not prevent the application of an active noise attenuation system in motor vehicles as was expected from previously known noise cancellation systems.

Furthermore, it will be appreciated that any of the previously known improvements employed in noise cancellation systems may be more easily incorporated in limited spaces. For example, where multiple transducers must be used in order to cancel out feedback pulses or to directionalize the cancellation pulses, the power requirements for driving the transducers can be substantially reduced. Moreover, the housing defining the chambers can be used to reduce the effect of heat and other environmental conditions which reduce the useful life of the transducer or other components of the noise cancellation system.

Having thus described the present invention, many modifications thereto will become apparent to those skilled in the art to which is pertains without departing from the scope and spirit of the present invention as defined in the appended claims.

I claim:

1. An active, noise cancellation apparatus for a conduit comprising:

a sensor for generating a sensor signal representative of an input pulse train;

a transducer having a front side and a rear side;

means for mounting said transducer adjacent to the conduit;

electronic control means for driving said transducer in response to said sensor signal and producing an output pulse train having a phase opposite to said input pulse train at a predetermined point; and means for acoustically separating said front side from said rear side and acoustically coupling said front and rear sides of said transducer with said conduit.

2. The invention as defined in claim 1 wherein said means for acoustically separating and coupling comprises a chamber on one of said front and rear sides of said transducer including a port in communication with the conduit.

3. The invention as defined in claim 2 wherein said means for acoustically separating and coupling comprises a chamber on each of said front and rear sides of said transducer each chamber including a port in communication with the conduit.

4. The invention as defined in claim 3 wherein said ports are longitudinally spaced along the duct.

5. The invention as defined in claim 4 wherein the noise signal has a range of pulse train frequencies and the length of said spacing between the ports is less than the wavelength of the highest frequency pulse train to be transmitted through said conduit.

6. An active muffler for a motor vehicle exhaust conduit comprising:

a sensor for generating a sensor signal representative of pressure pulses in the conduit;

at least one transducer positioned for inducing pressure pulses in said conduit at least one location along said conduit;

electronic control means for driving said transducer to produce cancellation signals of opposite phase to said generated signal at a predetermined point;

wherein said transducer has a first side and an opposite second side adapted to generate pulses of opposite phase; and means for acoustically separating said first side from said second side and acoustically coupling said first and second sides of said transducer to said conduit.

7. The invention as defined in claim 6 wherein said means for acoustically separating and coupling comprises a peripheral wall of said conduit.

8. The invention as defined in claim 6 wherein said means for acoustically separating and coupling comprise a first chamber enclosing said first side, a second chamber enclosing said second side, a first port in communication with said conduit and said first chamber and a second port in communication with said conduit and said second chamber.

* * * * *